US007242786B2

(12) United States Patent
Åsnes

(10) Patent No.: US 7,242,786 B2
(45) Date of Patent: Jul. 10, 2007

(54) VIBRATOR DAMPING

(75) Inventor: Kristian Åsnes, Mölndal (SE)

(73) Assignee: P & B Research AB, Göteborg (SE)

( * ) Notice: Subject to any disclaimer, the term of this patent is extended or adjusted under 35 U.S.C. 154(b) by 136 days.

(21) Appl. No.: 10/481,588

(22) PCT Filed: Jun. 6, 2002

(86) PCT No.: PCT/SE02/01087

§ 371 (c)(1),
(2), (4) Date: Jul. 13, 2004

(87) PCT Pub. No.: WO03/013188

PCT Pub. Date: Feb. 13, 2003

(65) Prior Publication Data

US 2004/0236176 A1 Nov. 25, 2004

(30) Foreign Application Priority Data

Jun. 21, 2001 (SE) ..... 0102206

(51) Int. Cl.
*H04R 25/00* (2006.01)

(52) U.S. Cl. ..... 381/326; 381/151; 600/25

(58) Field of Classification Search ..... 381/151, 381/415, 417, 326, 380; 600/25; 623/10; 128/1 R See application file for complete search history.

(56) References Cited

U.S. PATENT DOCUMENTS 2,402,392 A * 6/1946 Goldschmidt ..... 381/418
4,123,675 A 10/1978 Moskowitz et al.
4,414,437 A 11/1983 Trauernicht et al.
4,498,461 A 2/1985 Hakansson
4,654,554 A 3/1987 Kishi
4,843,628 A * 6/1989 Hofer ..... 381/345
4,904,233 A * 2/1990 H.ang.kansson et al. ..... 600/25
5,255,328 A 10/1993 Akiniwa et al.
5,335,287 A 8/1994 Athanas
6,041,131 A 3/2000 Kirchhoefer et al.
6,751,334 B2 * 6/2004 Hakansson ..... 381/396
6,839,443 B2 * 1/2005 Fukuda ..... 381/151
2006/0025648 A1 * 2/2006 Lupin et al. ..... 600/25

OTHER PUBLICATIONS

Peder U. Carlsson; On Direct Bone Conduction Hearing Devices Advances in Transducer Technology and Measurement Methods; Paper C A transducer for hearing by direct bone conduction, pp. 1-32; and Paper D, Percutaneous vs transcutaneous transducers for hearing by direct bone conduction, pp. 1-16; Mar. 1990; Technical Report No. 195; Department of Applied Electronics, Chalmers University of Technology; Göteborg, Sweden.

* cited by examiner

*Primary Examiner*—Curtis Kuntz
*Assistant Examiner*—P. Dabney
(74) *Attorney, Agent, or Firm*—Venable LLP; Eric J. Franklin

(57) ABSTRACT

A variable-reluctance type vibrator for generating vibrations in a bone anchored hearing aid. The vibrator includes a vibrator plate and a bobbin base with a vibrator gap therebetween. The vibrator gap between the vibrator plate and the bobbin base, or some other spacing in the vibrator where a relative movement between two surfaces is generated during the vibratory function, is at least partially filled with a fluid or gel for providing the main part of the damping of the resonance frequency of the vibrator.

3 Claims, 1 Drawing Sheet

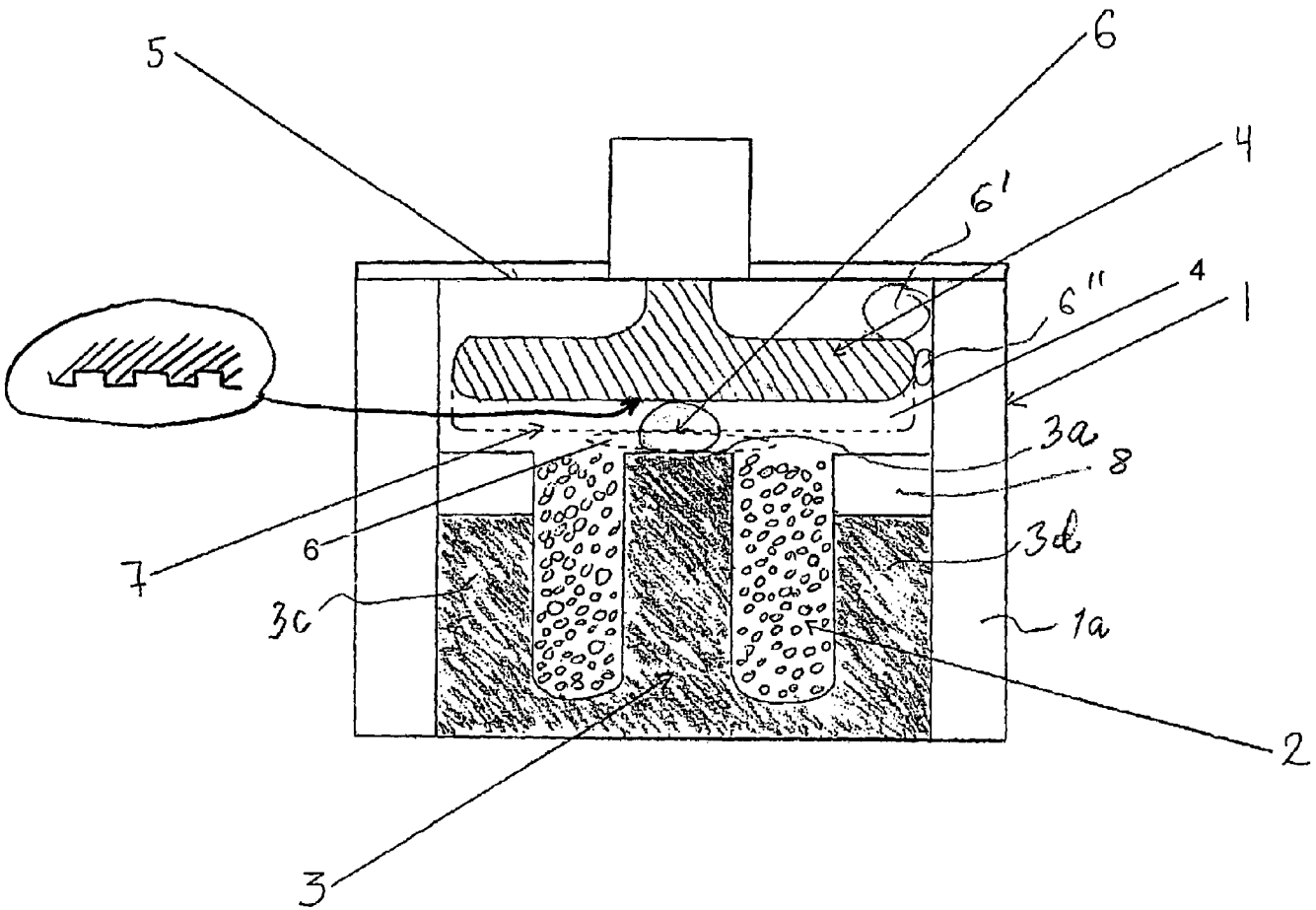
5
6
6'
4
6''
4
1
3a
8
3b
1a
2
7
6
3c
3

VIBRATOR DAMPING

CROSS-REFERENCE TO RELATED APPLICATIONS

This application claims priority to Swedish patent application 0102206-0 filed 21 Jun. 2001 and is the national phase under 35 U.S.C. § 371 of PCT/SE02/01087.

FIELD OF THE INVENTION

The present invention relates to a vibrator of the variable-reluctance type for generating vibrations in a bone anchored hearing aid, i e a hearing aid of the type in which the sound information is mechanically transmitted via the skull bone directly to the inner ear of a person with impaired hearing. The vibrator can be used for conventional, bone anchored as well as implantable bone conducting hearing aids.

BACKGROUND OF THE INVENTION

For persons with impaired hearing, the hearing aid devices which are most commonly used today are those based on the principle that the sound is amplified and fed into the auditory meatus and stimulates the eardrum from the outside. In order to prevent acoustic feedback problems in these devices, the auditory meatus is almost completely plugged by a hearing plug or by the hearing aid device itself. This causes the user a feeling of pressure, discomfort, and sometimes even eczema. In some cases it even causes the user problems like running ears due to chronic ear inflammations or infections in the auditory canal.

However, there are other types of sound transmitting hearing aids on the market, i e bone anchored hearing aids which mechanically transmit the sound information to a persons inner ear via the skull bone by means of a vibrator. The hearing aid device is connected to an implanted titanium screw installed in the bone behind the external ear and the sound is transmitted via the skull bone to the cochlea (inner ear), i e the hearing aid works irrespective of a disease in the middle ear or not. The bone anchoring principle means that the skin is penetrated which makes the vibratory transmission very efficient.

This type of hearing aid device has been a revolution for the rehabilitation of patients with certain types of impaired hearing. It is very convenient for the patient and almost invisible with normal hair styles. It can easily be connected to the implanted titanium fixture by means of a bayonet coupling or a snap in coupling. One example of this type of hearing aid device is described in U.S. Pat. No. 4,498,461 and it is also referred to the BAHA® bone anchored hearing aid marketed by Entific Medical Systems in Göteborg.

Other types of bone conducting hearing aids are described in U.S. Pat. No. 4,904,233 and our Swedish patent application 0002071-9.

A common feature for the hearing aid devices which have been described so far is that some type of vibratory generating means, vibrators, are required. Different types of vibrators are well known in the art. There are a number of known vibrator principles today. In traditional as well as in bone anchored hearing aid devices it is normally used a vibrator principle which was described already by Bell in 1876. There is a detailed description of this principle applied on a bone anchored, bone conducting hearing aid device in "On Direct Bone Conduction Hearing Devices", Technical Report No. 195, Department of Applied Electronics, Chalmers University of Technology, 1990. Other vibrators of this type are described in our Swedish patent applications 0002072-7 and 0002073-5.

In order to reduce the risk for acoustic feed back problems in the hearing aid it is necessary to damp the resonance frequency of the vibrator. In this context it is referred to Swedish Patent No. 85.02426-3 in which it is illustrated a vibrator comprising a vibrator plate and a coil which is wound around bobbin base having a core and two side walls. It also comprises means for damping the resonance frequency of the vibrator in the form of a spring provided with a layer of damping material or a built-in damping material.

It has turned out that this type of vibrator with a damping spring not always gives an optimal function of the hearing aid. The damping spring is a mechanically complicated and exposed part in the hearing aid.

SUMMARY OF THE INVENTION

It is an object of the present invention to provide a vibrator device having a more rugged damping system and having only a few mechanically sensitive parts. According to the invention the vibrator comprises at least one gap or spacing in which a relative movement between two surfaces is generated during the vibratory function and which gap or spacing at least partially is filled with a fluid or gel for providing the main part of the damping of the resonance frequency of the vibrator.

According to a preferred embodiment said fluid or gel is arranged in the vibrator gap between the vibrator plate and the bobbin base.

According to a further preferred embodiment the fluid comprises ferro-magnetic particles, forming a so-called ferro-fluid.

BRIEF DESCRIPTION OF THE DRAWING

In the following the invention will be described more in detail with reference to the accompanying drawing which illustrates a cross-sectional view of a preferred embodiment of the vibrator.

DETAILED DESCRIPTION OF EMBODIMENTS OF THE INVENTION

The FIGURE shows a cross-section through the centre axis of a vibrator 1 of the variable-reluctance types. The vibrator comprises a coil 2 which in the known way is wound around a bobbin base 3 having a core 3*a* and two side walls 3*c*, 3*d*. In the two side walls there are two annular permanent magnets 8 arranged. The entire coil and magnet arrangement is housed in a casing 1*a* which forms a part of the magnetic circuit and protects the vibrator and reduces magnetic leakage. The bobbin base and the casing are made of a material with high magnetic conductivity. The vibrator further comprises a vibrator plate 4 attached to a spring 5 which spring in turn is attached to the casing of the vibrator. In order to damp the resonance frequency of the vibrator, the gap 7 between the vibrator plate 4 and the upper part of the bobbin base, in this case the end surface of the core of the bobbin core 3*a*, is filled with a fluid or gel 6.

Through its viscosity a capillary properties the fluid 6 has the ability to damp the resonance frequency of the vibrator and thereby reduce the risk for acoustic feed back problems in the hearing aid. In order to keep the fluid in place, but also in order to increase the magnetic conductivity of the magnetic circuit, the fluid is preferably a so-called ferro-fluid, which fluid in addition to the fluid itself (oil, hydraulic oil) comprises small ferro-magnetic particles to make the fluid magnetic conductive.

If the vibrator 1 is squeezed together and if the surfaces of the vibrator plate and the bobbin base which then are pressed against each other are adapted to each other, for instance if the surfaces are plane and smooth, there is a risk that the ferro-magnetic particles are crashed by the pressure. Therefore it could be an advantage to provide the surfaces with certain irregularities so that the ferro-magnetic particles in the fluid could be transported to areas where they are not exposed to such pressure. These irregularities could for instance be designed as circular grooves, holes, cavities, bosses or the like while the contact surfaces otherwise are plane and smooth.

In the example illustrated here the fluid or gel 6 is schematically illustrated in the gap between the vibrator plate 4 and the bobbin base 3, which gap or spacing is exposed to the magnetic field. It should be understood, however, that the fluid or gel could be disposed in another gap or spacing in the vibrator where there is a relative movement between two surfaces during the vibratory function but without the magnetic field, for instance on that part of the vibrator plate which is faced away from the bobbin base. This location is symbolically illustrated by reference numeral 6' in the FIGURE.

As an alternative the fluid or gel could be disposed in a gap where there is a relative side movement between two surfaces when the vibrator is working, for instance on the outer edge of the vibrator plate. This is symbolically illustrated by reference numeral 6" in the FIGURE.

The invention claimed is:

1. A variable-reluctance type vibrator for generating vibrations in a bone anchored hearing aid, in which sound information is mechanically transmitted via a skull bone directly to an inner ear of a person with impaired hearing, the vibrator comprising:

a vibrator plate;

a bobbin base;

a casing surrounding the vibrator plate and the bobbin base;

at least one gap or spacing between the vibrator plate and other parts of the vibrator, wherein a relative movement between the vibrator plate and the other parts of the vibrator is generated during a vibratory function, the at least one gap or spacing comprising a first vibrator gap or spacing between a first side of the vibrator plate and the bobbin base, a second gap or spacing between the other side of the vibrator plate and the casing of the vibrator, and a third gap or spacing between the outer edge of the vibrator plate and the casing; and a magnetically conductive fluid or gel at least partially filling the at least one gap or spacing to at least partially damp a resonance frequency of the vibrator, wherein the fluid or gel is arranged at least in one of said first gap or spacing, the second gap or spacing or the third gap or spacing.

2. The vibrator according to claim 1, wherein said magnetically conductive fluid or gel comprises oil and ferro-magnetic particles.

3. The vibrator according to claim 2, wherein the vibrator gap comprises contact surfaces including cavities or holes where the ferro-magnetic particles can be collected when the contact surfaces are squeezed together in the at least one vibrator gap or spacing.

* * * * *